United States Patent [19]

Miles

[11] Patent Number: 4,475,675

[45] Date of Patent: Oct. 9, 1984

[54] PROTECTIVE PAD FOR GUN HOLSTER

[76] Inventor: Frank N. Miles, P.O. Box 160003, Sacramento, Calif. 95816

[21] Appl. No.: 430,715

[22] Filed: Sep. 30, 1982

[51] Int. Cl.[3] ..... F41C 33/02

[52] U.S. Cl. ..... 224/191; 206/317; 224/911

[58] Field of Search ..... 224/911, 912, 192, 193, 224/198, 238, 243, 191; 2/54, 56, 181; 206/205, 206/207, 317

[56] References Cited

U.S. PATENT DOCUMENTS

| | | | |
|---|---|---|---|
| 896,004 | 8/1908 | Gaskill | 224/911 X |
| 944,355 | 12/1909 | Beasley | 224/911 X |
| 1,547,800 | 7/1925 | Franz | 224/911 X |
| 2,313,381 | 3/1943 | King | 2/181 |
| 2,455,635 | 12/1948 | Witte | 224/912 X |
| 2,914,377 | 11/1959 | Bull | 206/205 X |
| 2,987,229 | 6/1961 | Leclerc | 224/911 X |
| 3,001,201 | 9/1961 | Hauser | 2/56 |
| 3,197,098 | 7/1965 | Clark | 224/911 X |
| 3,420,420 | 1/1969 | Clark | 224/911 X |
| 3,578,736 | 5/1971 | Dootson | 2/181 |
| 3,902,639 | 9/1975 | Rogers | 224/912 X |
| 4,190,183 | 2/1980 | Yates | 224/911 X |
| 4,257,464 | 3/1981 | Binney | 206/317 X |

*Primary Examiner*—Allan N. Shoap

[57] ABSTRACT

A holster which retards migration of saline moisture such as perspiration to the enclosed weapon. A laminate defines an outer moisture resistant layer and an intermediate layer which serves as a hydrophilic attractant to sacrificially accept moisture to the exclusion of the leather adjacent the gun.

5 Claims, 2 Drawing Figures

PROTECTIVE PAD FOR GUN HOLSTER

BACKGROUND OF THE INVENTION

This invention relates generally to holsters for handguns and more specifically to preventing the permeation of sweat and moisture through the face of the holster closest to the body of the user. Anyone who has carried a handgun in a holster, such as law enforcement officers and those in the military, are aware of the advantages and disadvantages associated with using a holster made of leather.

A leather holster is more attractive and has a better overall feel to it than a holster constructed from a synthetic material such as plastic or the like. However, since leather is somewhat porous and will absorb moisture, it is known that moisture often permeates the layers of the holster and may cause a rusting or corroding of the internal mechanism or the external appearance of the gun contained therein.

A prominent source of the moisture which reaches through the holster and corrodes the gun contained therein is provided by the user's perspiration which permeates the surface of the holster closest to the body of the user, particularly when the holster is worn at the side of a person such that the back face of the holster is in constant contact with the side or the thigh of the user. This arrangement obviously supplies a constant source of moisture to that face of the holster.

The invention according to the instant application is distinguished thereover by providing a back face of the holster with a laminate layer of teflon or the like, thereby preventing any permeation of moisture through that face of the holster. The aesthetical and functional qualities of leather are maintained because the remainder of the holster both inside and out is constructed from a leather or a similar substance having the same feel.

The following patents reflect the state of the art of which applicant is aware that appear to be germane to the patent process: U.S. Pat. Nos. 2,455,635 Witte, 2,987,229 Leclerc, 3,902,639 Rogers.

The device according to the instant application is further distinguished from the above citations in that the holsters according to those disclosures are constructed completely from plastic, thereby relinquishing the beneficial attributes of leather such as flexibility, appearance and feel. This is accomplished by providing a holster in which only a face of the holster contacting the body of the user is covered with a laminate layer in order to prevent permeation of moisture from the body of the user through the porous leather to the gun surfaces which should be maintained in such a manner as to prevent rusting or corrosion of the metal components.

OBJECTS AND SUMMARY OF THE INVENTION

Accordingly, this invention has as an object the provision of a new and improved holster provided on the outside of a back surface which is closest to the body of the user, a laminated face of teflon or the like which prevents the permeation of moisture produced by the body of the user through the back surface of the holster to the vital metallic components of the handgun.

It is a further object of this invention to provide a new and improved handgun holster which slides easily across the thigh of the user, thereby not getting caught and interfering with the mobility of the user.

It is still a further object of this invention to provide a new and improved holster for a handgun which retains all the advantageous qualities of a leather holster, such as appearance, feel, and flexibility.

It is still yet a further object of this invention to provide a new and improved handgun holster in which the laminate layer applied to the back surface of the holster curves around towards the front of the holster thereby forming a lip at the terminal edge of the laminate which is positioned so as to prevent the lip from engaging any clothing or the like as the holster itself slides across the surface of the user's thigh.

These and other objects will be made manifest when considering the following detailed specification when taken in conjunction with the appended drawing figures.

BRIEF DESCRIPTION OF THE PREFERRED EMBODIMENT

Figure 1:
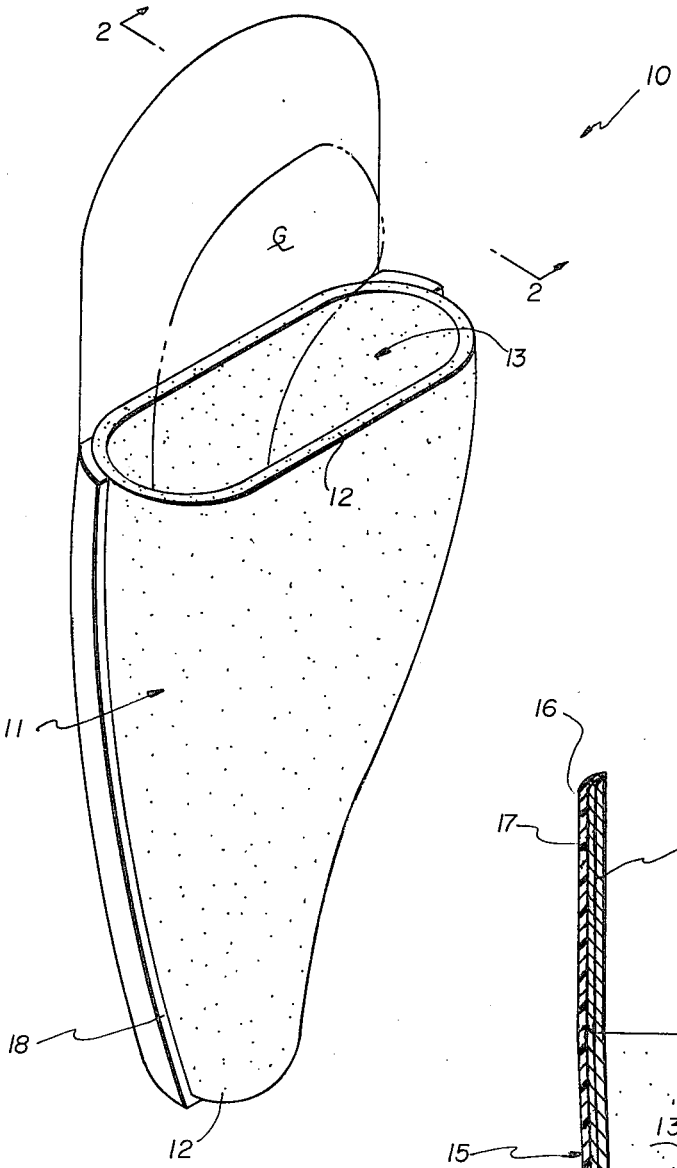
FIG. 1 is a perspective view of the holster according to the instant invention.

Referring now to the drawings in detail wherein like reference numerals represent like parts throughout the several figures, reference numeral 10 refers generally to the device according to the instant application.

In this figure, a gun handle G is shown in phantom as it would appear when stored in the holster 10. The body of the holster 11 has an upper lip 12 defining an opening 13 which is large enough to receive the body of a handgun. The opposite end of the body 11 tapers to a rounded nose 12 which generally conforms to the barrel of a handgun. Preferably, the body 11 of the holster 10 is constructed from leather, thereby taking advantage of the appearance, feel, and flexibility provided by that substance.

Figure 2:
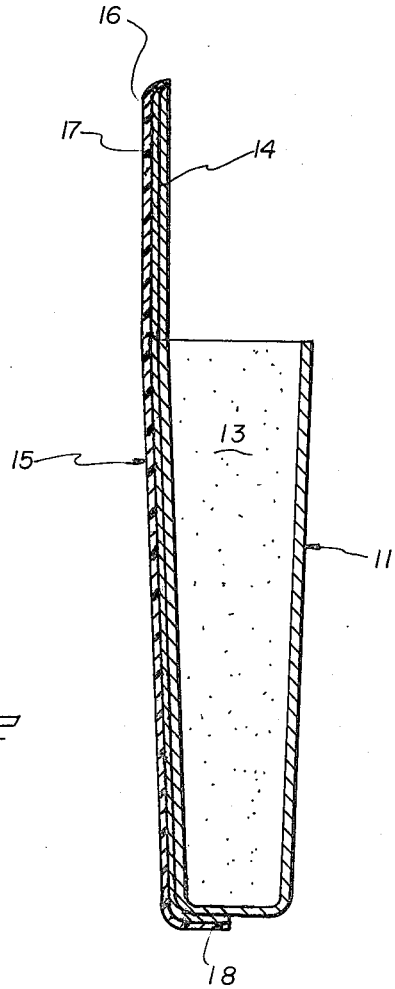
FIG. 2 is a sectional view taken along lines 2—2 of FIG. 1.

Referring now to FIG. 2, the back face or surface, generally referred to by reference numeral 15, of the holster is formed of a laminate of three different layers. The innermost layer 14 includes a flap which is an extension of the leather body 11 forming the holster 10 and defines a tab to fasten the holster. The intermediate layer 16 is a cloth like material that allows any moisture to preferably migrate thereto as by wicking action to serve as a hydrophilic layer relative to the leather to preserve the leather.

Layer 16 and teflon back surface 17 extend around the body 11 of the holster 10 defining a folded marginal edge portion in order that the peripheral edges 18, FIG. 1, do not provide pressure areas or snags for the user.

Thus, the device 10 according to the instant invention provides a non-permeable teflon back surface 17 to the holster so that moisture from the body of the user is not allowed to seep through and corrode or spoil the metallic components of the gun contained in the holster 10, and the cloth layer will absorb saline perspiration to the exclusion of the leather and gun. Adhesive/or fusion bonding can effect the lamination.

Having thus described the preferred embodiment of the invention, it should be understood that numerous structural modifications and adaptations may be resorted to without departing from the spirit of the invention.

What is claimed is:

1. A holster for a handgun with a non-permeable back surface comprising in combination:

a downwardly tapered pouch with an opening on a top portion thereof to receive a handgun, a laminate layer back surface on said pouch to prevent the permeation of moisture into said pouch through said back surface, a flap extending upwardly from said laminate behind of said pouch adapted to provide an upwardly extending tab to fasten said pouch in a desired position, wherein said laminate layer back surface includes a first layer of cloth affixed to and substantially the same size as and shape as said back surface of said pouch, and a second layer of teflon affixed to and the same size and shape as said first layer.

2. The device of claim 1 wherein said laminate layer back surface extends and curves on its edges toward the front surface of said pouch, terminating in a folded outer marginal position whereby said edges of said laminate layer will not engage and become caught on clothing of a user of the holster.

3. The device of claim 2 wherein said layers are adhesively bonded together.

4. The device of claim 2 wherein said layers are fused together.

5. The device of claim 2 wherein said cloth is hydrophilic.

* * * * *